US011208820B2

(12) United States Patent
Litteral

(10) Patent No.: US 11,208,820 B2
(45) Date of Patent: Dec. 28, 2021

(54) APPARATUS FOR MAINTAINING POOL OR SPA FULL LEVEL

(71) Applicant: James Litteral, St. Cloud, FL (US)

(72) Inventor: James Litteral, St. Cloud, FL (US)

( * ) Notice: Subject to any disclaimer, the term of this patent is extended or adjusted under 35 U.S.C. 154(b) by 0 days.

(21) Appl. No.: 16/949,390

(22) Filed: Oct. 28, 2020

(65) Prior Publication Data

US 2021/0040758 A1 Feb. 11, 2021

Related U.S. Application Data

(63) Continuation-in-part of application No. 16/666,343, filed on Oct. 28, 2019.

(60) Provisional application No. 62/751,687, filed on Oct. 28, 2018.

(51) Int. Cl.
*E04H 4/12* (2006.01)

(52) U.S. Cl.
CPC ..... *E04H 4/12* (2013.01)

(58) Field of Classification Search
CPC ..... E04H 4/12; E04H 4/1209; E04H 4/1218; E04H 4/1281
See application file for complete search history.

(56) References Cited

U.S. PATENT DOCUMENTS

| | | | | |
|---|---|---|---|---|
| 3,893,470 | A * | 7/1975 | MacPhee | G05D 9/12 137/101.27 |
| 5,836,022 | A | 11/1998 | Busenga | |
| 7,934,517 | B2 | 5/2011 | Morrison | |
| 8,875,731 | B2 | 11/2014 | Larsen | |
| 2005/0000011 | A1 | 1/2005 | Swanson et al. | |
| 2009/0260149 | A1 | 10/2009 | Booth | |
| 2014/0140862 | A1 | 5/2014 | Elbaz et al. | |
| 2021/0102393 | A1 | 4/2021 | Tucker | |

FOREIGN PATENT DOCUMENTS

| | | |
|---|---|---|
| GB | 2302162 A | 8/1997 |

OTHER PUBLICATIONS

Non-Final Office action in related U.S. Appl. No. 16/666,343 dated Apr. 19, 2021; 9 pages.

* cited by examiner

*Primary Examiner* — J C Jacyna
(74) *Attorney, Agent, or Firm* — Kelly G. Swartz; Widerman Malek, PL

(57) ABSTRACT

A system for maintaining a water level in a body of water including a float valve and a securing member. The securing member includes a support member secured to the float valve, an adjustable member, and a horizontal member having a first end secured to the support member and an opposing, second end rotatably secured to the adjustable member.

19 Claims, 7 Drawing Sheets

APPARATUS FOR MAINTAINING POOL OR SPA FULL LEVEL

RELATED APPLICATIONS

This application is a continuation-in-part of and claims priority under 35 U.S.C. § 120 of U.S. patent application Ser. No. 16/666,343 filed on Oct. 28, 2019 and titled Apparatus for Maintaining Pool or Spa Full Level—Staypoollizer. The content of this application is incorporated herein by reference.

FIELD OF THE INVENTION

The present invention relates to systems and methods for maintaining a fluid level in a body of water. More specifically, this invention is related to a system for connecting a water source to a nozzle configuring a float valve to control the nozzle dependent upon the water level in the body of water.

BACKGROUND OF THE INVENTION

In the ever-growing pool market, there exists a need to automate the process of replenishing water loss. Low water level can cause serious damage to pool water recirculating and sanitizing sub-systems. Manual replenishment of lost water is time consuming and requires constant monitoring for proper fill level. Known automated methods and systems for maintaining water level require modifications to apparatus based on the setting in which they are used. A known automated system utilizes a mechanical float cut-off action closed and opened by a sealing surface connected to a water buoyant component, but this system has a high failure rate resulting in overfilling. Therefore, a need exists for a reliable system deployable in a variety of environments.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the above in mind, embodiments of the present invention are related to a system for maintaining a water level in a body of water including a float valve, a securing member and a nozzle.

The securing member may include a support member secured to the float valve, an adjustable member, and a horizontal member having a first end secured to the support member and an opposing, second end rotatably secured to the adjustable member.

The support member may include a cross-member secured directly to the float valve and a vertical member secured to the cross-member. The cross-member and the vertical member may be secured perpendicularly to one another.

The second end of the horizontal member may include a hollow tube rotatably carrying at least a portion of the adjustable member.

The adjustable member may be continuously positionable to form an angle between zero and three hundred sixty degrees with respect to the horizontal member. The adjustable member may include a mounting member carried by and parallel to the hollow tube; a first extension member secured to a first end of the mounting member; and a second extension member secured to a second end of the mounting member. The first extension member and second extension member may be parallel to one another and perpendicular to the mounting member.

The first extension member may include a first slip resistant surface disposed along an entirety of at least a portion of an outer perimeter surface of the first extension member. The second extension member may include a second slip resistant surface disposed along an entirety of at least a portion of an outer perimeter surface of the second extension member. The horizontal member may include a slip resistant surface disposed along an entirety of at least a portion of an outer perimeter surface of the horizontal member.

The float valve may include a housing and a float. The housing may have a hollow interior and a top surface having an orifice in fluid communication with the nozzle. The float may be pivotally secured within the hollow interior of the housing, below the top surface. The float may occlude the orifice when the water level in the body of water is at or above a desired water level. The float valve may also include a connector secured to the top surface of the housing and adapted to carry the nozzle.

The nozzle may include an inlet tube and an outlet tube. The inlet tube may have an inner diameter. The outlet tube may have an inner diameter less than the inner diameter of the inlet tube. The inner diameter of the outlet tube may be between 0.125 and 0.123 inches. The first end of the outlet tube may be flared forty-five degrees relative to a longitudinal axis of the outlet tube.

The nozzle may further include a threaded connector adapted to secure to the connector of the float valve. At least a portion of the outlet tube may be carried within the threaded connector of the nozzle.

The nozzle may include a flange nut secured to an outer diameter of the outlet tube and captured by the threaded connector. Epoxy resin may be located within an entirety of a void between the outer diameter of the outlet tube and an inner diameter of the threaded connector.

The nozzle may include a hose connector coupled to the threaded connector of the nozzle in a swivel configuration.

The system may include a joint secured between the hose connector and the threaded connector. The joint may be operable to position a fluid inlet of the hose connector at a ninety-degree angle with respect to a fluid outlet of the outlet tube.

The inner diameter of the outlet tube may be between 0.125 and 0.123 inches and the outer diameter of the outlet tube may be between 0.16 and 0.15 inches.

BRIEF DESCRIPTION OF THE DRAWINGS

Some embodiments of the present invention are illustrated as an example and are not limited by the figures of the accompanying drawings, in which like references may indicate similar elements.

DETAILED DESCRIPTION OF THE INVENTION

Figure 1:
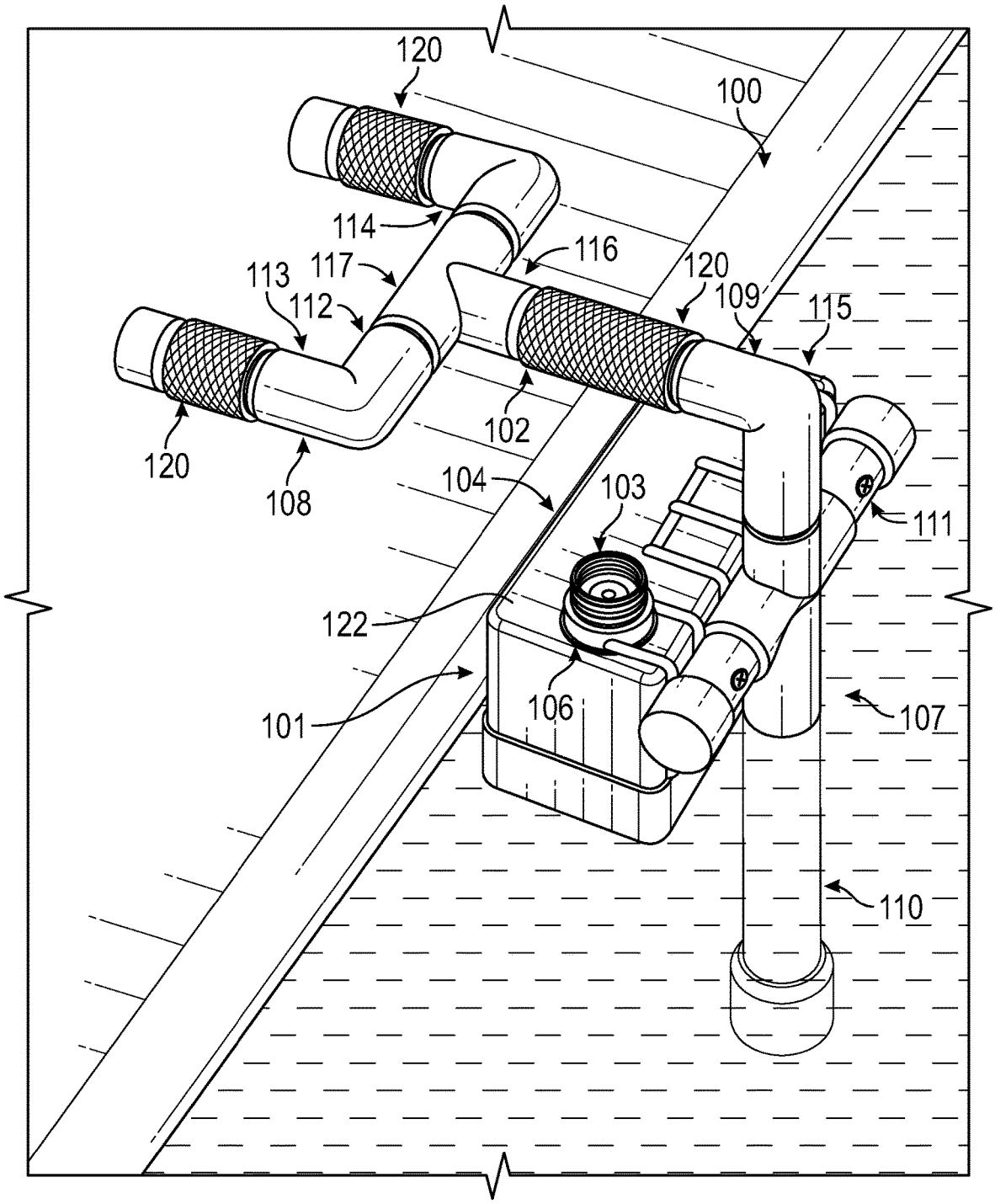
FIG. 1 is an environmental view of a system for maintaining a water level according to an embodiment of the present invention.
Figure 2:
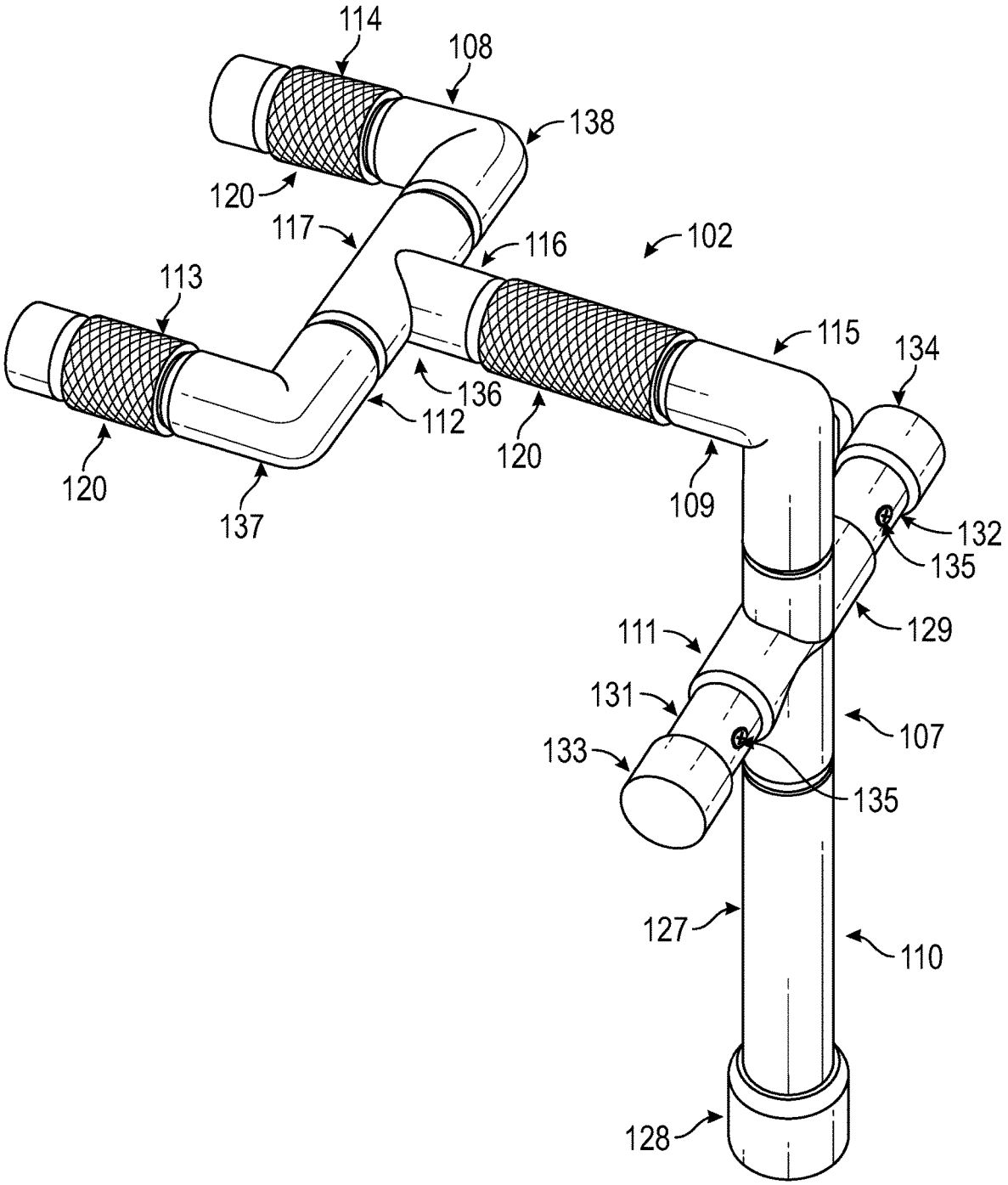
FIG. 2 is a perspective view of a securing member of the system for maintaining a water level of FIG. 1.
Figure 3:
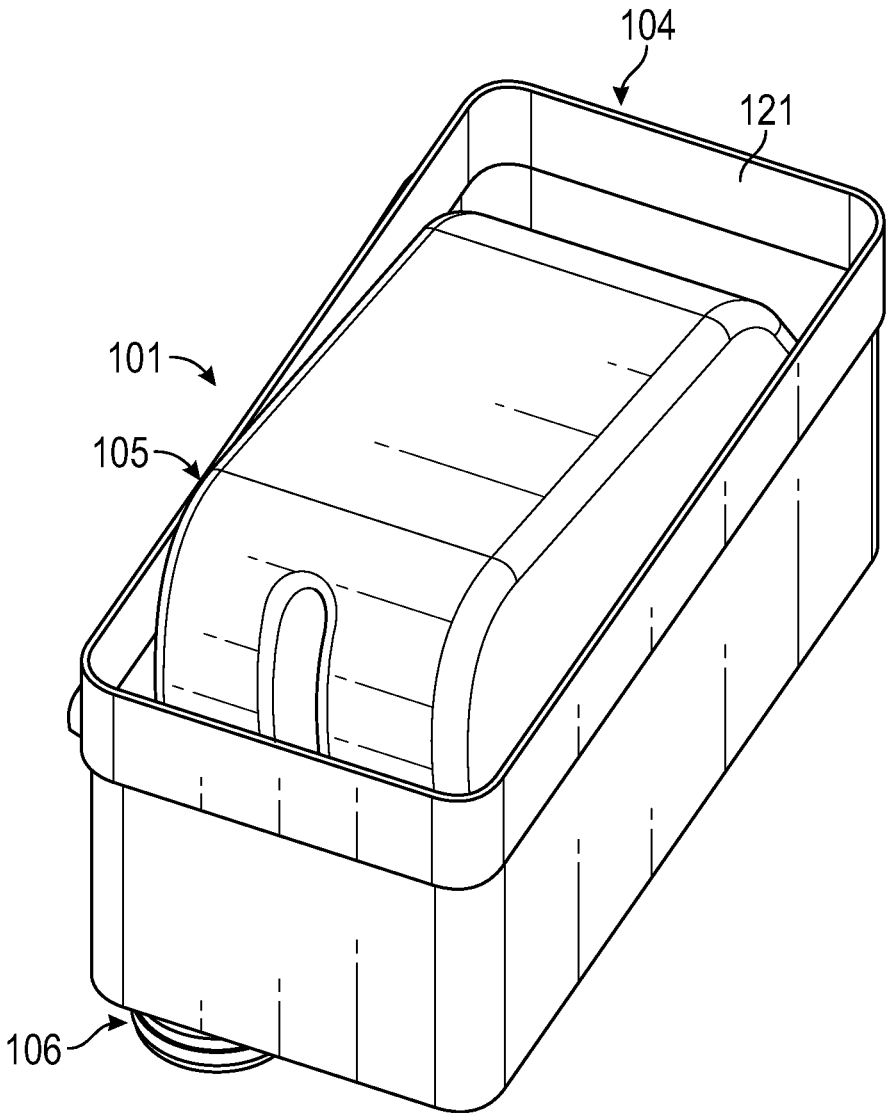
FIG. 3 is a perspective view of a float valve of the system for maintaining a water level of FIG. 1.
Figure 4:
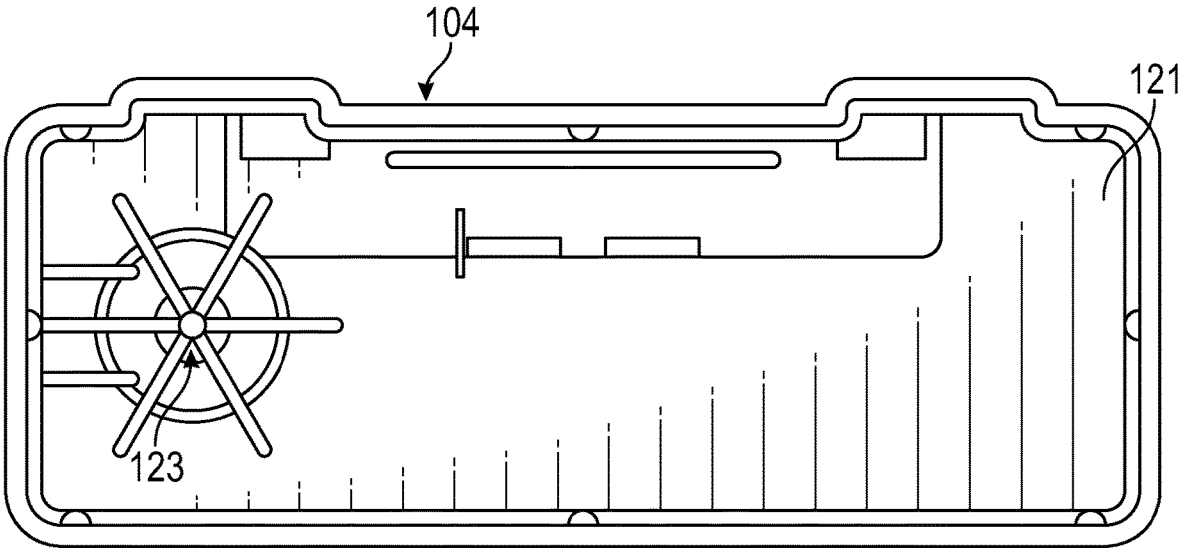
FIG. 4 is a top plan view of the float valve of FIG. 3.
Figure 5:
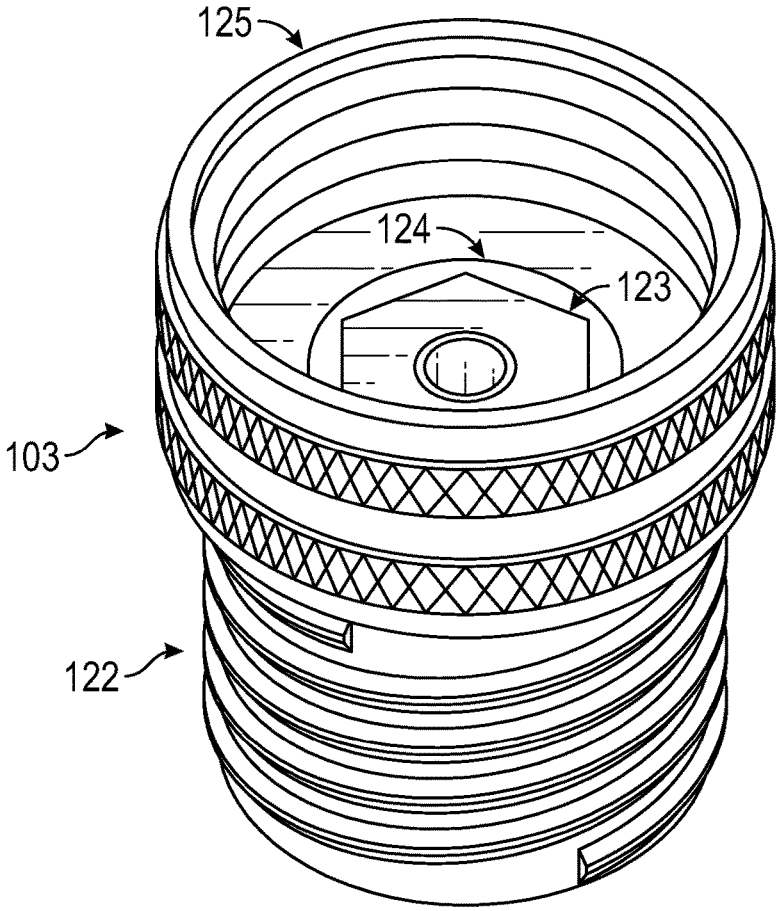
FIG. 5 is a top perspective view of a nozzle of the system for maintaining a water level of FIG. 1.
Figure 6:
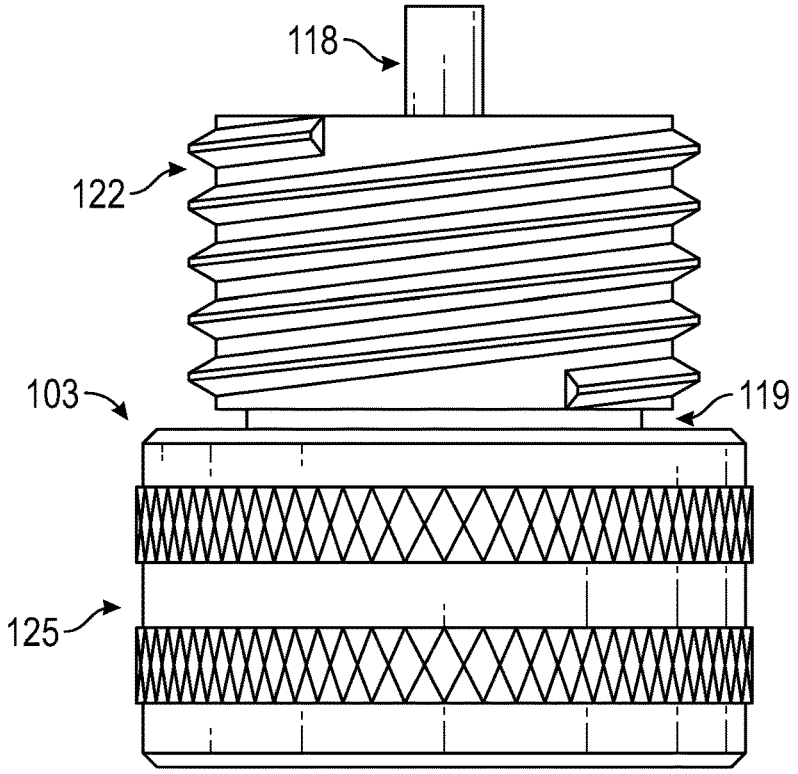
FIG. 6 is a side elevation view of the nozzle of FIG. 5.
Figure 7:
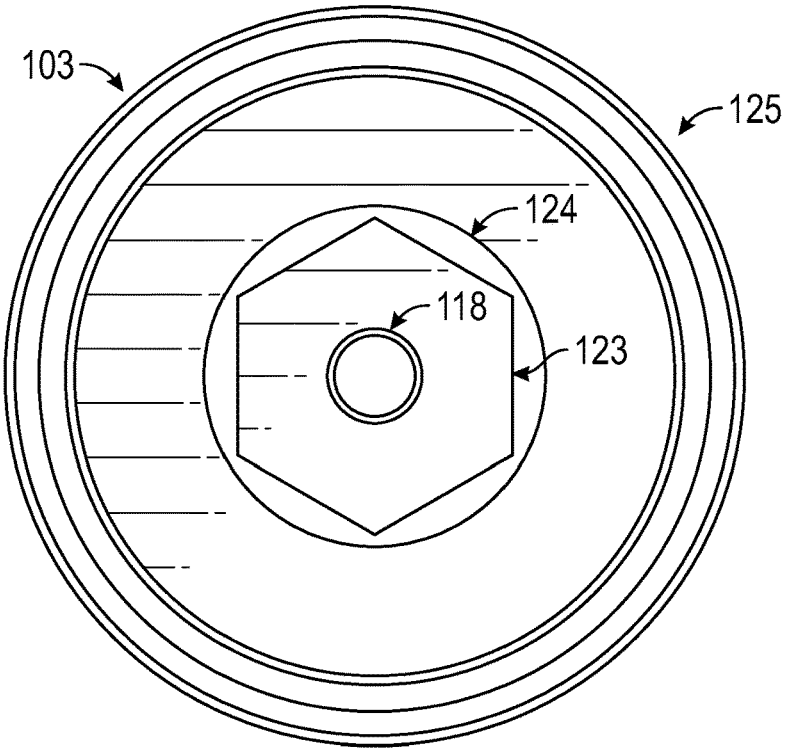
FIG. 7 is a top plan view of the nozzle of FIG. 5
Figure 8:
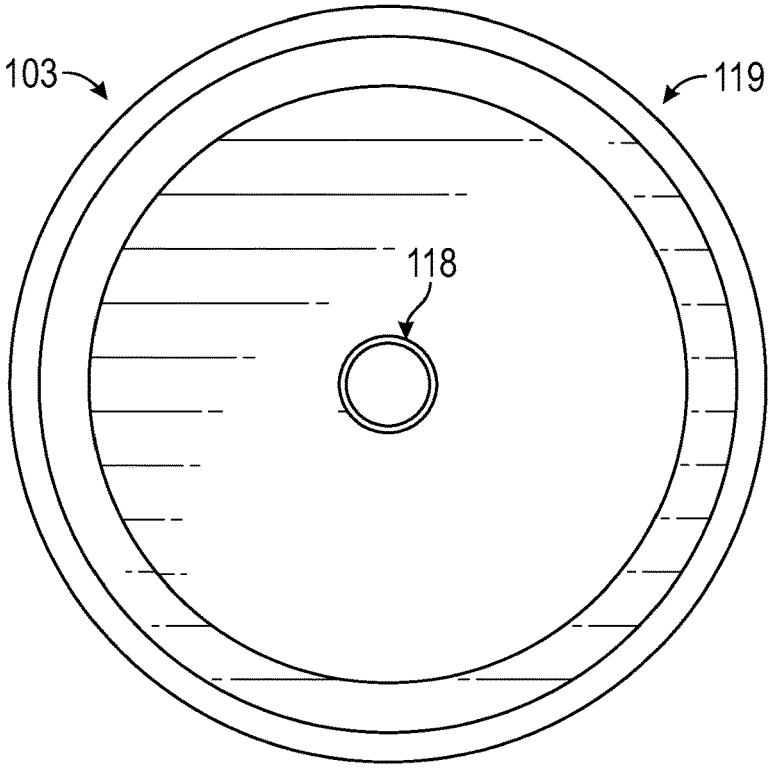
FIG. 8 is a bottom plan view of the nozzle of FIG. 5.
Figure 9:
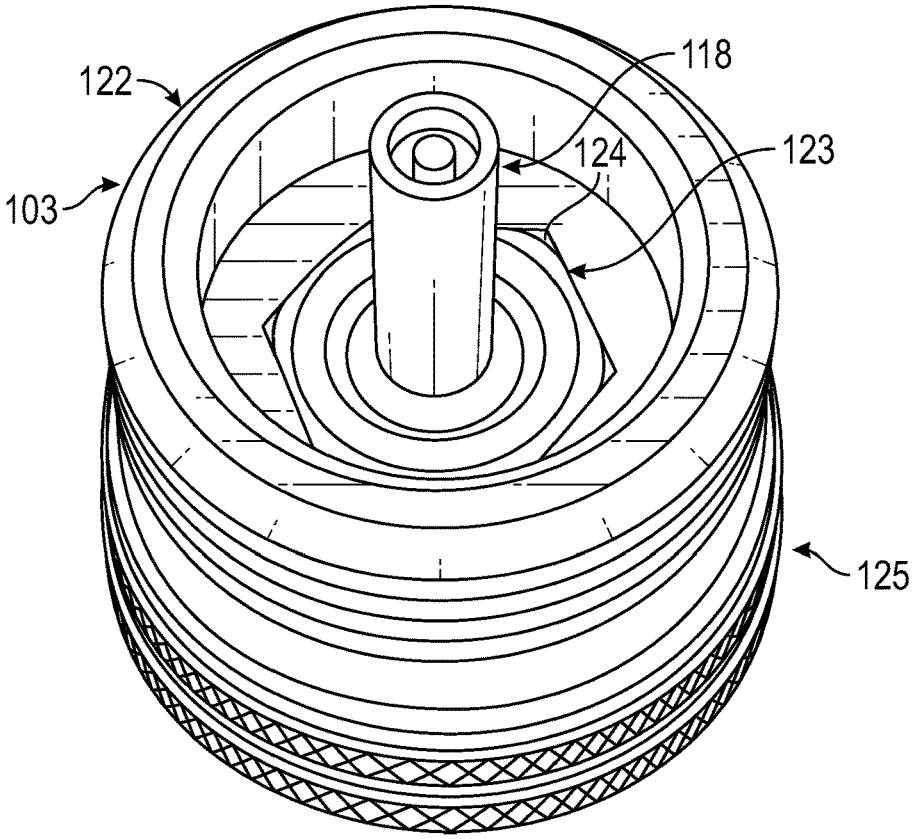
FIG. 9 is a bottom perspective view of the nozzle of FIG. 5.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

An embodiment of the invention, as shown and described by the various figures and accompanying text, provides a system for maintaining a water level 100. The system may include a float valve 101, a securing member 102, and a nozzle 103. The securing member 102 may carry the nozzle 103 and float valve 101 and anchor the system 100 at a particular location to position the float valve 101 along a surface of the body of water. The nozzle 103 may be connected to a water source providing water to the body of water. As the water surface rises to a desired level, the float valve 101 may be operable to occlude the nozzle 103 to prevent further water from entering the body of water. As the water level falls, the float valve 101 may be operable to move away from an outlet tube 118 of the nozzle 103 and allow water to flow into the body of water to raise the water level.

The securing member 102 may include a support member 107, an adjustable member 108, and a horizontal member 109. The components of the securing member 102 may include hollow tubes, caps, and connectors. In one embodiment, the securing member 102 may include PVC components, which are particularly well suited to the environment in which the system for maintaining a water level 100 may be utilized.

The support member 107 may secure directly to the float valve 101. The support member 107 may include a cross-member 111 and a vertical member 110. The vertical member 110 may secure to the cross-member 111 perpendicularly to one another. When the system is in operation, the cross-member 111 may be positioned parallel to the surface of the body of water and the vertical member 110 may be positioned along a plane ninety degrees from the plane of the surface of the water. In one embodiment, the vertical member 110 may include a vertical hollow tube 127 having a vertical tube cap 128 on a first end. A second end of the vertical hollow tube may be secured to an equal cross fitting 129. The vertical hollow tube 127 may terminate within the equal cross fitting 129 or extend through the equal cross fitting 129 and protrude from a pair of opposing outlet portions of the equal cross fitting 129. In embodiments in which the vertical hollow tube 127 terminates within the equal cross fitting, a second vertical hollow tube may be capture by and extend from an outlet portion of the equal cross fitting 129 opposing the outlet portion secured to the first vertical hollow tube 127.

The equal cross fitting 129 may be hollow and have four outlet portions. Each of the four outlet portions may directly oppose another outlet portion and form a ninety-degree angle with two other outlet portions. The first or second hollow tube portion 127 extending from the outlet portion of the equal cross fitting 129 directly opposing the outlet portion secured to the second end of the first vertical member 127 may secure to a first end of a ninety-degree elbow 130. The vertical member 110 may include all or parts of the ninety-degree elbow 130, equal cross fitting 129, first vertical hollow tube 127, second vertical hollow tube, and vertical tube cap 128.

The cross member 111 may include the two outlet portions of the equal cross fitting 129 not secured to portions of the vertical member 110. Each of these outlet portions of the cross member 111 may be secured to a first end of a hollow tube 131, 132. The second ends of each of these hollow tubes 131, 132 may be secured to respective cross member caps 133, 134. Alternatively, the cross member 111 may include a single hollow tube 131 extending through the equal cross fitting 129 from a first side to a second, opposing side. In such an embodiment, each end of the single hollow tube 131 may be secured to a respective cross member cap 133, 134. The cross member 111 may include one or more fasteners 135 adapted to secure directly to the housing 104 of the float valve 101. In one embodiment, the one or more fasteners 135 may be a pair of screws.

The horizontal member 109 may have a first end 115 secured to the ninety-degree elbow 130 of the support member 107 and a second, opposing end 116 secured to a tee member 136. The tee member 136 may include a hollow tube 117 to rotatably capture and secure to the adjustable member 108. The adjustable member may be rotatably positionable with respect to the horizontal member 109.

The adjustable member 108 may include a mounting member 112, which may be a single tube, carried by the hollow tube 117 and extending from opposing ends of the hollow tube 117 of the tee member 136. Each end of the mounting member 112 may be secured to a first end of a respective elbow 137, 138. In one embodiment, each elbow 137, 138 may form a ninety-degree angle. The second end of each elbow 137, 138 may secure to a first end of an extension member 113, 114. The extension members 113, 114 may be parallel to one another and perpendicular to the mounting member 112. The second end of each extension member 113, 114 may secure to a respective extension cap 139, 140. The adjustable member 108 may be rotated within the hollow tube 117 to position the extension members 113 at any angle between zero and three hundred sixty degrees with respect to the horizontal member 109. Adjusting the angle of the adjustable member 108 may allow the system to be placed and retained on the side of a body of water regardless of the structure of the surface surrounding the body of water. By way of example, when the body of water is a swimming pool, there may be a coping surrounding the pool that angles up, down, or remains flat. The adjustable member 108 may be positioned to maximize contact with the surface upon which it rests regardless of the angle of the coping.

To further retain the system 100 in the desired position, a portion of the system 100 may include a slip resistant surface 120. In one embodiment, a slip resistant surface 120 may be located along an entirety of portion of an outer perimeter surface of each extension member 113, 114. A slip resistant surface 120 may be located along an entirety of a portion of an outer perimeter surface of the horizontal member 109.

The float valve 101 may include a housing 104, a float 105, and a connector 106. The housing 104 may have a hollow interior 121 and a top surface 122 with an orifice 123 disposed through an entirety of the thickness of the top surface 122. The orifice 123 may be in fluid communication with the nozzle 103 of the system 100. The connector 106 may be secured to the top surface 122 of the housing 104, be adapted to carry the nozzle 103, and position the nozzle in fluid communication with the orifice 123.

The float 105 may pivotally secure to the housing 105 within the hollow interior 121 of the housing 104 below the top surface 122. The float 105 may be a hollow, generally rectangular, buoyant structure. The top surface of the float 105 may rise and fall as the water level of the body of water rises and falls. As the water level rises, a neoprene washer of the float 105 may contact and occlude the orifice 123 of the housing 104 and prevent water from passing through the nozzle 103 into the body of water. As the water level falls, the float 105 may move away from the orifice 123 of the housing 104 and allow water to pass through the nozzle 103 and enter the body of water. At a desired water level, the float 105 may prevent additional water from entering the body of water through the nozzle 103. When the water level drops below a desired water level, the float 105 may allow additional water to enter the body of water through the nozzle 103.

Figure 10:
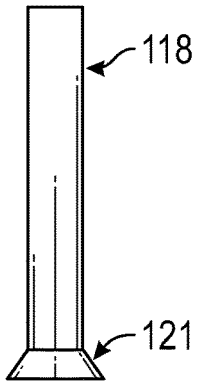
FIG. 10 is a side elevation view of the outlet tube of the nozzle of FIG. 5.
Figure 11:
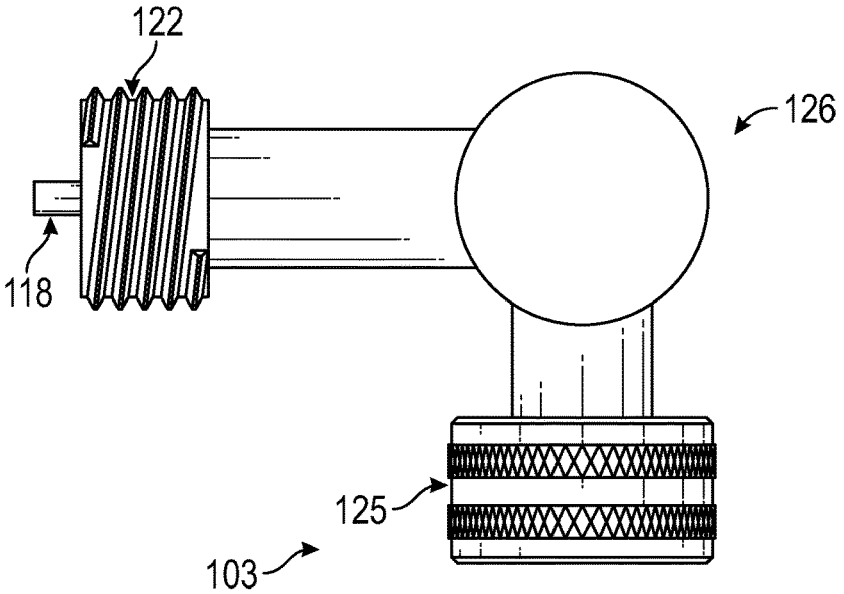
FIG. 11 is a side elevation view of a nozzle of the system for maintaining a water level according to an embodiment of the present invention.
Figure 12:
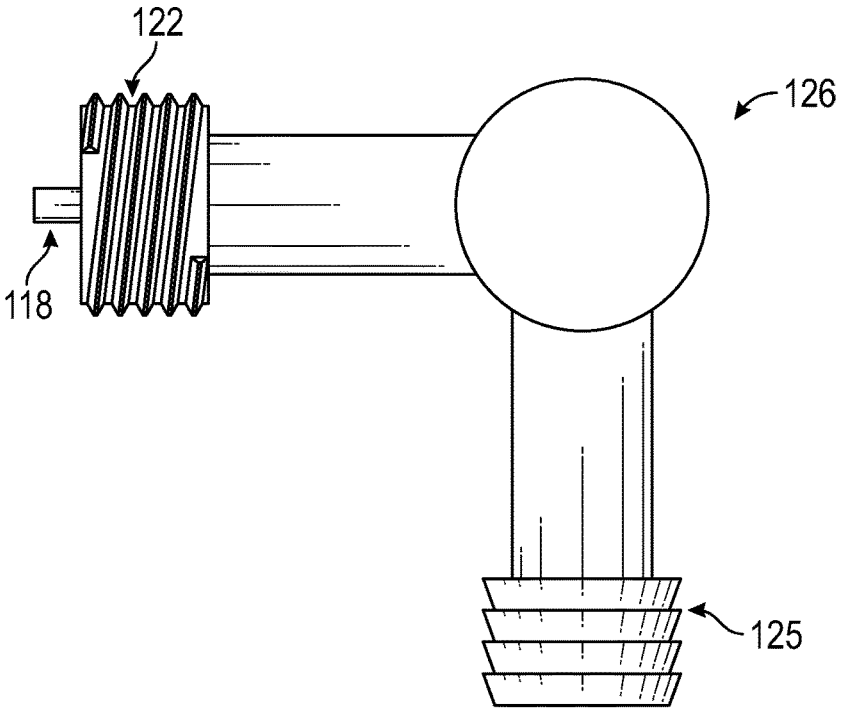
FIG. 12 is a side elevation view of a nozzle of the system for maintaining a water level according to an embodiment of the present invention.

The nozzle 103 may include an inlet tube 119 adapted to receive water entering the nozzle 103. The inlet tube 119 may have an inner diameter. The nozzle 103 may also include an outlet tube 118 adapted to expel water from the nozzle 103 into the orifice 123 of the housing 104. The outlet tube 118 may have an inner diameter less than the inner diameter of the inlet tube 119. In one embodiment, the inner diameter of the outlet tube may be between 0.125 and 0.123 inches. In one embodiment, the inner diameter of the outlet tube may be 0.124 inches. The outlet tube 118 may have an outer diameter between 0.16 and 0.15 inches. In one embodiment, the outer diameter of the outlet tube 118 may be 0.155 inches. A first end 121 of the outlet tube 118 may be positioned proximate the inlet to the nozzle 103 with a second end of the outlet tube 118 positioned proximate the orifice 123 of the housing 104. As depicted in FIG. 10, the first end 121 of the outlet tube 118 may be flared. In one embodiment, the flare of the outlet tube 118 may form a forty-five degree angle with a longitudinal axis of the outlet tube 118.

The nozzle 103 may include a threaded connector 122. The threaded connector 122 may be adapted to mate with threads on the connector 106 of the float valve 101. In one embodiment, the threaded connector 122 of the nozzle 103 may have threads located on an outer perimeter, which mate with threads on an inner perimeter of the connector 106 of the float valve 101. The threaded connector 122 of the nozzle 103 may surround and carry at least a portion of the outlet tube 118. The threaded connector 122 of the nozzle 103 may secure to the inlet tube 119 of the nozzle 103.

The nozzle 103 may include a flange nut 123, which may be positioned between the outlet tube 118 and the threaded connector 122. The first end 121 of the outlet tube 118 may be positioned within a center void of the flange nut 123. The flange nut 123 may secure to an outer diameter of the outlet tube 118. The flange nut 123 may be captured by and carried within the threaded connector 122. The flange nut 123 may be positioned within an inner perimeter of the threaded connector 122. Space between an outer perimeter of the flange nut 123 and the inner perimeter of the threaded connector 122 may be filled with epoxy resin 124. Additionally, epoxy resin 124 may fill an entirety of a void between the outer diameter of the outlet tube 118 and the inner diameter of the threaded connector 122.

The nozzle may include a hose connector 125. The hose connecter 125 may be adapted to secure to a hose, which provides water to increase the level of the body of water. In one embodiment, the hose connector 125 may include threads located on an inner diameter of the inlet tube 119. In another embodiment, the hose connector 125 may include a quick connect style connector secured to or positioned on an exterior perimeter of the inlet tube 119. The hose connector 125 may be coupled to the threaded connector 122 of the nozzle 103. When secured to one another, the hose connector 125 and the threaded connector 122 may swivel with respect to one another. In one embodiment, a joint 126 may be positioned between the hose connector 125 and the threaded connector 122. In such an embodiment, the joint 126 may be operable to position the fluid inlet of the hose connector 125 at angle of other than one hundred eighty degrees with respect to the fluid outlet of the outlet tube 118. In one embodiment, the joint 126 may be operable to achieve an angle between one hundred eighty and ninety degrees.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus the scope of the invention should be determined by the appended claims and their legal equivalents, and not by the examples given.

The claims in the instant application are different than those of the parent application or other related applications. Applicant therefore rescinds any disclaimer of claim scope made in the parent application or any predecessor application in relation to the instant application. Any such previous disclaimer and the cited references that it was made to avoid, may need to be revisited. Further, any disclaimer made in the instant application should not be read into or against the parent application.

What is claimed is:

1. A system for maintaining a water level in a body of water comprising:
- a float valve; and
- a securing member comprising:
  - a support member secured to the float valve,
  - an adjustable member, and
  - a horizontal member having a first end secured to the support member and an opposing, second end comprising a hollow tube rotatably secured to and carrying at least a portion of the adjustable member.

2. The system of claim 1 wherein the support member further comprises:
- a cross-member secured directly to the float valve; and
- a vertical member secured to the cross-member; and
- wherein the cross-member and the vertical member are secured perpendicularly to one another.

3. The system of claim 1 wherein the adjustable member is continuously positionable to form an angle between zero and three hundred sixty degrees with respect to the horizontal member.

4. The system of claim 1 wherein the adjustable member further comprises:
- a mounting member carried by and parallel to the hollow tube;
- a first extension member secured to a first end of the mounting member; and
- a second extension member secured to a second end of the mounting member; and
- wherein the first extension member and second extension member are parallel one another and perpendicular to the mounting member.

5. The system of claim 4 wherein the first extension member comprises a first slip resistant surface disposed along an entirety of at least a portion of an outer perimeter surface of the first extension member; and
- the second extension member comprises a second slip resistant surface disposed along an entirety of at least a portion of an outer perimeter surface of the second extension member.

6. The system of claim 1 wherein the horizontal member further comprises a slip resistant surface disposed along an entirety of at least a portion of an outer perimeter surface of the horizontal member.

7. The system of claim 1 further comprising:
- a nozzle; and
- wherein the float valve comprises:
  - a housing having a hollow interior and a top surface having an orifice in fluid communication with the nozzle,
  - a float pivotally secured within the hollow interior of the housing, below the top surface, and
- wherein the float occludes the orifice when the water level in the body of water is at or above a desired water level.

8. The system of claim 7 wherein the float valve further comprises:
- a connector secured to the top surface of the housing and adapted to carry the nozzle.

9. The system of claim 7 wherein the nozzle comprises:
- an inlet tube having an inner diameter; and
- an outlet tube having an inner diameter less than the inner diameter of the inlet tube.

10. The system of claim 9 wherein the inner diameter of the outlet tube is between 0.125 and 0.123 inches.

11. The system of claim 9 wherein a first end of the outlet tube is flared forty-five degrees relative to a longitudinal axis of the outlet tube.

12. The system of claim 9 wherein the nozzle further comprises:
- a threaded connector adapted to secure to the connector of the float valve; and
- wherein at least a portion of the outlet tube is carried within the threaded connector of the nozzle.

13. The system of claim 12 wherein the nozzle further comprises a flange nut secured to an outer diameter of the outlet tube and captured by the threaded connector.

14. The system of claim 13 further comprising epoxy resin located within an entirety of a void between the outer diameter of the outlet tube and an inner diameter of the threaded connector.

15. The system of claim 12 wherein the nozzle further comprises:
- a hose connector coupled to the threaded connector of the nozzle in a swivel configuration.

16. The system of claim 15 further comprising a joint secured between the hose connector and the threaded connector wherein the joint is operable to position a fluid inlet of the hose connector at a ninety-degree angle with respect to a fluid outlet of the outlet tube.

17. A system for maintaining a water level in a body of water comprising:
- a float valve comprising:
  - a housing having a hollow interior and a top surface having an orifice,
  - a float pivotally secured within the hollow interior of the housing, below the top surface;
- a securing member comprising:
  - a support member secured to the housing of the float valve, an adjustable member, a horizontal member having a first end secured to the support member and an opposing, second end rotatably secured to the adjustable member; and a nozzle in fluid communication with the orifice of the housing; and wherein the float occludes the orifice when the water level in the body of water is at or above a desired water level.

18. A system for maintaining a water level in a body of water comprising:

a float valve comprising:

a housing having a hollow interior and a top surface having an orifice, a float pivotally secured within the hollow interior of the housing, below the top surface, and a connector secured to the top surface of the housing and adapted to carry a nozzle;

a securing member comprising:

a support member secured to the housing of the float valve, an adjustable member, a horizontal member having a first end secured to the support member and an opposing, second end rotatably secured to the adjustable member; and the nozzle in fluid communication with the orifice of the housing wherein the nozzle further comprises:

a threaded connector adapted to secure to the connector of the float valve, an inlet tube having an inner diameter, a outlet tube having an inner diameter less than the inner diameter of the inlet tube, a flange nut secured to an outer diameter of the outlet tube and captured by the threaded connector, epoxy located within an entirety of a void between the outer diameter of the outlet tube and an inner diameter of the threaded connector; and wherein the float occludes the orifice when the water level in the body of water is at or above a desired water level.

19. The system of claim 18 wherein the inner diameter of the outlet tube is between 0.125 and 0.123 inches and the outer diameter of the outlet tube is between 0.16 and 0.15 inches.

* * * * *